US008523747B2

(12) United States Patent
Hecky et al.

(10) Patent No.: US 8,523,747 B2
(45) Date of Patent: Sep. 3, 2013

(54) HOLLOW ROLLER WHICH CAN BE HEATED WITH STEAM

(75) Inventors: Thomas Hecky, Weiden (DE); Harald Tobies, Nidderau (DE)

(73) Assignee: BHS Corrugated Maschinen—und Anlagenbau GmbH, Weiherhammer (DE)

( * ) Notice: Subject to any disclaimer, the term of this patent is extended or adjusted under 35 U.S.C. 154(b) by 614 days.

(21) Appl. No.: 12/755,723

(22) Filed: Apr. 7, 2010

(65) Prior Publication Data

US 2010/0255971 A1 Oct. 7, 2010

(30) Foreign Application Priority Data

Apr. 7, 2009 (DE) ..... 10 2009 016 677

(51) Int. Cl.
*F26B 11/04* (2006.01)

(52) U.S. Cl.
USPC ..... 492/46; 492/16

(58) Field of Classification Search
USPC ..... 492/46, 16, 20
See application file for complete search history.

(56) References Cited

U.S. PATENT DOCUMENTS

| | | | | |
|---|---|---|---|---|
| 4,498,249 | A | 2/1985 | Cooke et al. | |
| 5,024,266 | A | 6/1991 | Critchlow | |
| 5,864,963 | A * | 2/1999 | Komulainen | 34/124 |
| 6,092,579 | A | 7/2000 | Bradatsch et al. | |
| 6,203,072 | B1 | 3/2001 | Berghuis et al. | |

FOREIGN PATENT DOCUMENTS

| | | | |
|---|---|---|---|
| DE | 19910125 | A1 | 10/2000 |
| DE | 60014815 | T2 | 12/2005 |
| EP | 0917949 | A2 | 5/1999 |
| EP | 0922921 | A2 | 6/1999 |

* cited by examiner

*Primary Examiner* — David Bryant
*Assistant Examiner* — Christopher Besler
(74) *Attorney, Agent, or Firm* — Browdy and Neimark, PLLC

(57) ABSTRACT

A hollow roller, which is heatable with steam, has an inner wall. It is rotatably mounted and has a steam supply channel opening into the interior and a siphon pipe, which opens into the interior coaxially to a centre longitudinal axis, with a suction opening located adjacent to the inner wall. The siphon pipe is held in a rotary feed-through, which is pivotable relative to the centre longitudinal axis of the hollow roller about a pivot angle α in such a way that the spacing b of the suction opening from the inner wall is adjustable.

22 Claims, 8 Drawing Sheets

HOLLOW ROLLER WHICH CAN BE HEATED WITH STEAM

FIELD OF THE INVENTION

The invention relates to a hollow roller, which can be heated with steam, which has a roller shell with an inner wall, two end walls, a centre longitudinal axis and an interior, which is rotatably mounted, which has a steam supply channel opening into the interior coaxially to the centre longitudinal axis and which has a siphon pipe which opens into the interior coaxially to the centre longitudinal axis, with a suction opening located adjacent to the inner wall.

BACKGROUND OF THE INVENTION

A hollow roller which can be heated with steam in this way is used, for example, in the production of corrugated board as a so-called fluted roller, as known from U.S. Pat. No. 6,092,579. Furthermore, hollow rollers of this type, which can be heated with steam, are used as so-called preheating rollers in corrugated board systems in order to preheat paper webs. Further areas of use are to be found in other technical areas; hollow rollers of this type are regularly used to warm or heat materials guided over them in webs. In this case, on the one hand, steam, generally saturated steam or superheated steam is blasted into the inner hollow roller. It gives off its heat via the inner wall of the hollow roller to the shell thereof, whereupon the water vapour condenses. The condensate collects because of the gravitational force and the centrifugal force of the rotating hollow roller on the inner wall thereof. This condensate layer acts in an insulating manner and therefore disturbs the heat transfer from the steam onto the roller. To remove the condensate, a siphon pipe is used, the suction opening of which is located close to the inner wall of the hollow roller. The spacing of the suction opening of the siphon pipe from the inner wall of the hollow roller is decisive for the residual quantity of condensate located in the interior of the hollow roller. Moreover, when a siphon pipe rests on the inner wall of the roller shell, the suction opening may cut in, so the siphon pipe rests tightly on the inner wall with the consequence that condensate can no longer be removed by suction.

In a hollow roller of this type, which can be heated with steam, known from EP 0 922 921 B1, the siphon pipe consists of an outer rigid support pipe and a flexible insert pipe displaceably mounted therein, so the spacing of the suction opening from the inner wall of the hollow roller can be adjusted. It has been shown in practice that it is only possible to adjust the spacing of the suction opening from the inner wall of the hollow roller when the hollow roller is stationary, in other words in operating breaks.

SUMMARY OF THE INVENTION

It is therefore an object of the invention to develop a hollow roller, which can be heated with steam, of the generic type in such a way that an exact adjustment of the spacing between the suction opening and inner wall of the hollow roller is also possible during operation of the hollow roller.

This object is achieved according to the invention by the siphon pipe being formed rigidly and being held in a rotary feed-through, which is pivotable relative to the centre longitudinal axis about a pivot angle $\alpha$ in such a way that the spacing b of the suction opening from the inner wall is adjustable. As the adjustment of the spacing between the inner wall of the hollow roller and the suction opening of the siphon pipe is carried out by a pivoting of the rotary feed-through located outside the hollow roller and not rotating therewith, an adjustment of this type is also easily possible during the often high-speed operation of a hollow roller of this type. Readjustments during operation are also possible without a production system, in which the heatable hollow roller is located, having to be stopped. The siphon pipe resting on the hollow roller and therefore cutting in can thereby be avoided. The adjustment of the spacing of the suction opening from the inner wall may take place during operation in such a way that the siphon pipe is placed with its suction opening against the inner wall of the hollow roller. This can be detected acoustically or by measuring the vibration. The rotary feed-through is then adjusted about a predetermined angle, whereby the height of the gap between the suction opening and inner wall is fixed precisely. For this purpose, a corresponding display may be attached to the rotary feed-through.

The end wall adjacent to the rotary feed-through being provided with a hollow bearing journal, which is rotatably connected to a housing of the rotary feed-through so as to be pivotable about the pivot angle $\alpha$ in a steam-tight manner, the rotary feed-through having a steam supply connecting piece, which passes into the steam supply channel formed as a ring channel surrounding the siphon pipe, and the rotary feed-through being mounted on pivot bearings, depict advantageous configurations of the rotary feed-through.

A pivoting adjusting device being provided for the pivoting adjustment of the rotary feed-through with the siphon pipe, wherein the pivot bearing is arranged in a fixed manner, wherein the pivoting adjusting device is actuatable manually, wherein the pivoting adjusting device has adjusting screws for pivoting adjustment and wherein wherein the pivoting adjusting device is actuatable by a motor, depict various advantageous configurations of a pivoting adjusting device for the rotary feed-through.

The rotary feed-through with the siphon pipe being adjustable about the centre longitudinal axis about a rotation angle $\beta$, the rotary feed-through being mounted on a ring disc, which is rotatably and fixably supported, and the pivot bearings being attached to the ring disc, allow the suction opening to also be able to be pivoted and fixed in the peripheral direction, specifically in the rotational direction of the hollow roller, which, with regard to the high peripheral speeds of hollow rollers of this type in corresponding systems, has the advantage that condensate, because of being entrained on the inner wall of the hollow roller, is not removed by suction on the lowest roller base but further up.

Further features, advantages and details of the invention emerge from the following description of embodiments with the aid of the drawings.

DESCRIPTION OF THE PREFERRED EMBODIMENTS

Figure 1:
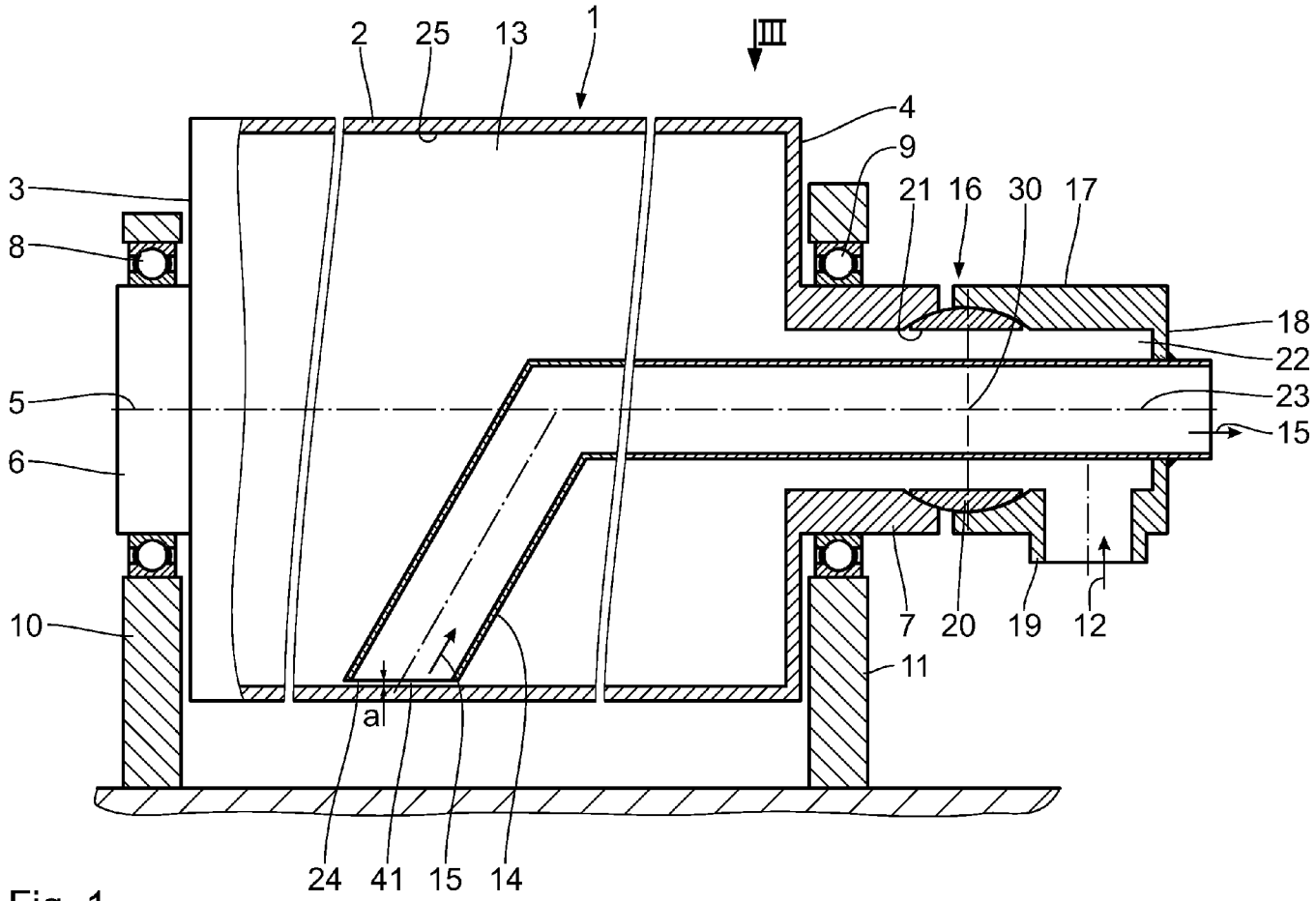
FIG. 1 shows a vertical longitudinal section through a hollow roller according to the invention in an operating position with a suction opening of the siphon pipe located on the inner wall of the hollow roller.

The heatable hollow roller 1 shown in the drawings has a substantially cylindrical roller shell 2, which is closed off in a steam-tight manner by two end walls 3 and 4. Attached to the two end walls 3, 4 concentrically to the centre longitudinal axis 5 of the hollow roller 1 are bearing journals 6, 7, which are mounted with roller bearings 8, 9 in bearing blocks 10, 11. The hollow roller 1 is thus rotatably mounted. Hollow rollers of this type can generally be rotatably driven. A rotary drive of this type, not shown in the drawings, can take place by means of the bearing journal 6 shown on the left in the drawings.

The bearing journal 7 shown on the right in the drawings is hollow. Water vapour coming from a water vapour source, not shown, in accordance with the flow direction arrow 12, is introduced into the hollow roller 1 through said bearing journal, so the roller shell 2 is heated. The water vapour condenses owing to this heating process and the heat output of the steam associated with it. The condensate is removed by suction from the lower region of the interior 13 of the hollow roller 1 by means of a so-called siphon pipe 14, the suction direction being indicated by the flow direction arrow 15. A negative pressure source, not shown, is connected to the siphon pipe 14.

The water vapour supply and the condensate removal by suction take place by means of a so-called rotary feed-through 16. This has a non-rotatable housing 17, which is arranged substantially concentrically to the axis 5 and carries on its outer base 18, the siphon pipe 14 rigidly connected to it. A vapour supply connecting piece 19 opens into the housing 17.

The housing 17 of the rotary feed-through 16 is rotatably connected by means of a universal ball joint bearing 20, and pivotably connected relative to the axis 5, to the bearing journal 7. The bearing 20 has a cylindrical inner wall 21, so, on the one hand, the siphon pipe 14 is also free of the universal ball joint bearing 20 and furthermore, between the siphon pipe 14 and the housing 17 or the bearing journal 7, a ring channel 22 is provided to supply the water vapour from the connecting piece 19 into the interior 13 of the hollow roller 1. The universal ball joint bearing 20 may consist of a suitable plastics material, so that it simultaneously rests against the housing 17 consisting of metal in each case, on the one hand, and the bearing journal 7 on the other hand, so a steam seal to the outside is formed. However, other suitable seals can also obviously be provided.

Figure 2:
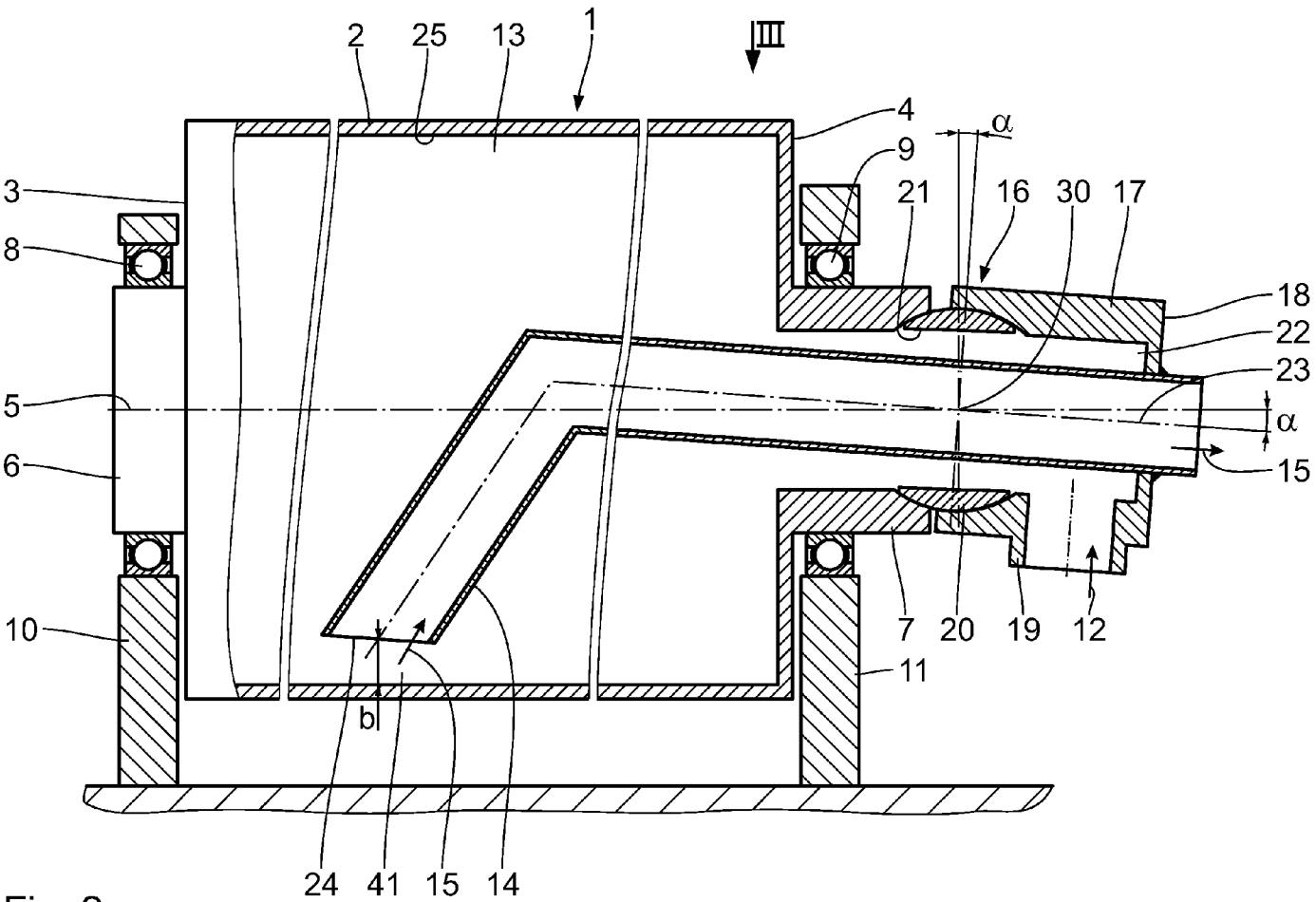
FIG. 2 shows the hollow roller according to FIG. 1 with the siphon pipe pivoted to a maximum height.

In the operating position according to FIG. 1, the main longitudinal axis 23 of the siphon pipe 14 runs aligned with the centre longitudinal axis 5 of the hollow roller 1. In this position of the siphon pipe 14, its inner lower suction opening 24 has a minimum spacing a from the inner wall 25 of the hollow roller 1. In the position of the siphon pipe 14 shown in FIG. 2, its main longitudinal axis 23 is pivoted about a pivot angle $\alpha$ relative to the centre longitudinal axis 5, so the suction opening 24 has a larger spacing b from the inner wall 25. This angle $\alpha$ may be up to 5°. The angle will generally be $\alpha \leqq 2°$.

Figure 3:
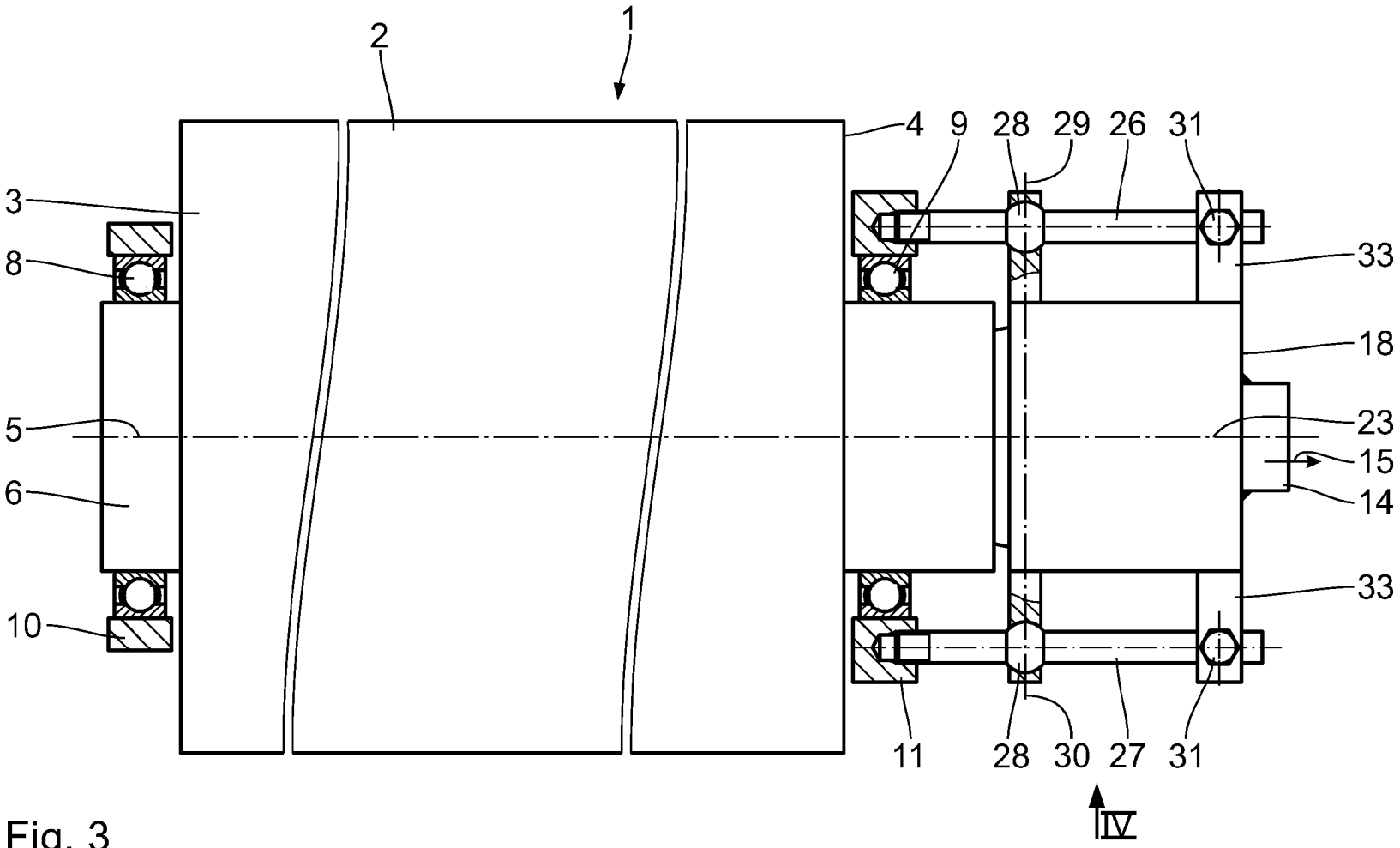
FIG. 3 shows a plan view of the hollow roller according to FIGS. 1 and 2 in accordance with the viewing arrow III in FIGS. 1, 2 and 4.
Figure 4:
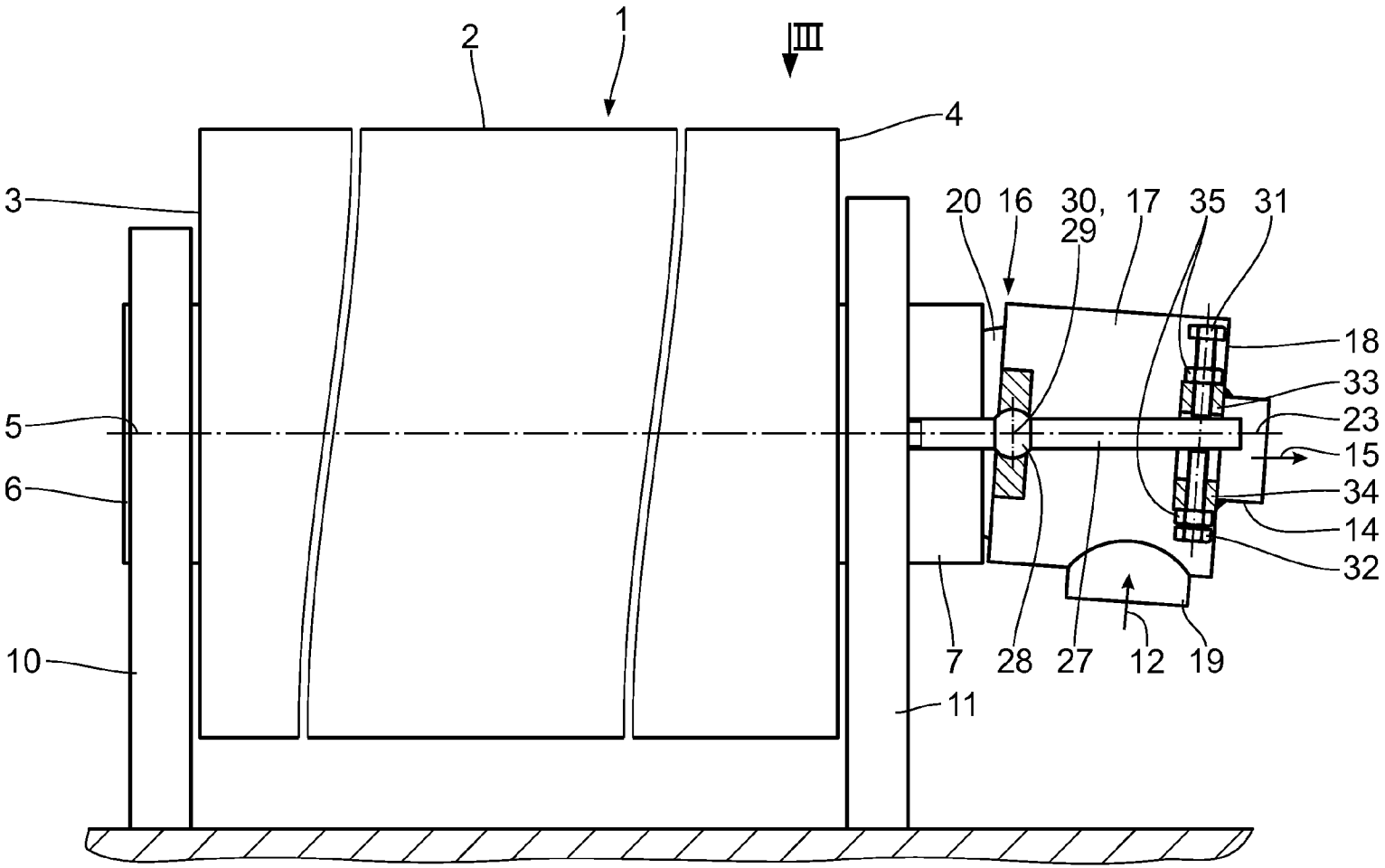
FIG. 4 shows a side longitudinal view of the hollow roller according to FIGS. 1 to 3 in accordance with the viewing arrow IV in FIG. 3.

A pivoting adjusting device to be actuated manually for the siphon pipe 14 emerges from FIGS. 3 and 4. In the bearing block 11 mounted on the hollow bearing journal 7, in a horizontal plane, in which the centre longitudinal axis 5 is also located, bearing rods 26, 27 are screwed on either side of the bearing journal 7 and the housing 17. The housing 17 of the rotary feed-through 16 is pivotably mounted by means of spherical pivot bearings 28 on these bearing rods 26, 27 so that the pivot movements described above with regard to FIGS. 1 and 2 can be carried out. The two spherical pivot bearings 28 have a common horizontal pivot axis 29, which runs aligned with the centre pivot axis 30 of the universal ball joint bearing 20.

The pivoting adjustment and fixing of the rotary feed-through 16 with the siphon pipe 14 takes place in the embodiment according to FIGS. 1 to 4 by means of two pairs of adjusting screws 31, 32 which are mounted in corresponding laterally projecting abutments 33, 34 and rest against the bearing rods 26 and 27. By corresponding unscrewing of the upper adjusting screws 31 out of the corresponding upper abutments 33 and corresponding screwing of the respective lower adjusting screw 32 into the corresponding lower abutment 35, the housing 17 of the rotary feed-through 16 is pivoted out of the position shown in FIG. 1 into the position shown in FIG. 2 and fixed there. This position is secured by counternuts 35.

Figure 5:
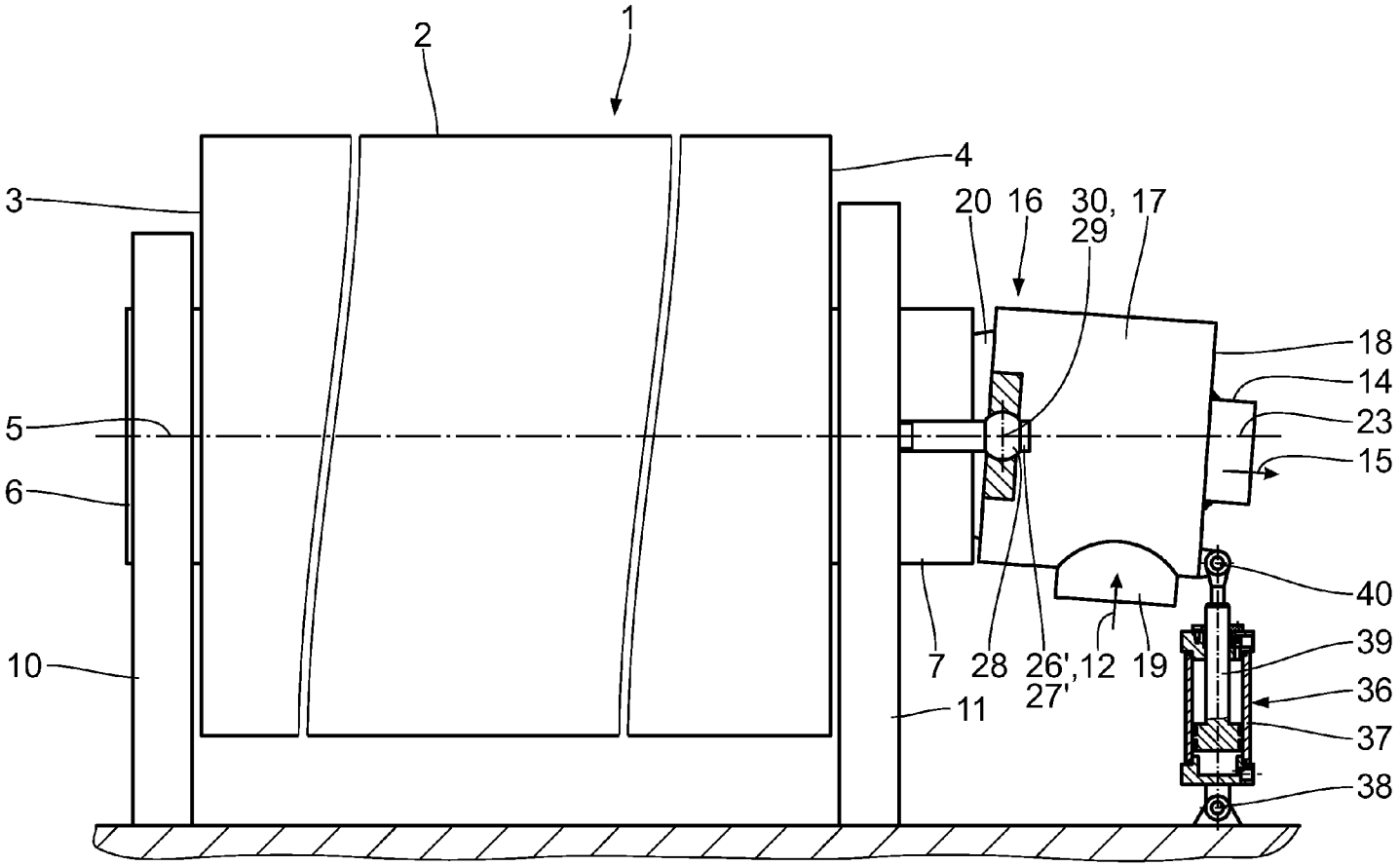
FIG. 5 shows a hollow roller in accordance with the view in FIG. 4 with a pivoting adjusting device which is changed compared to FIGS. 1 to 4.
Figure 6:
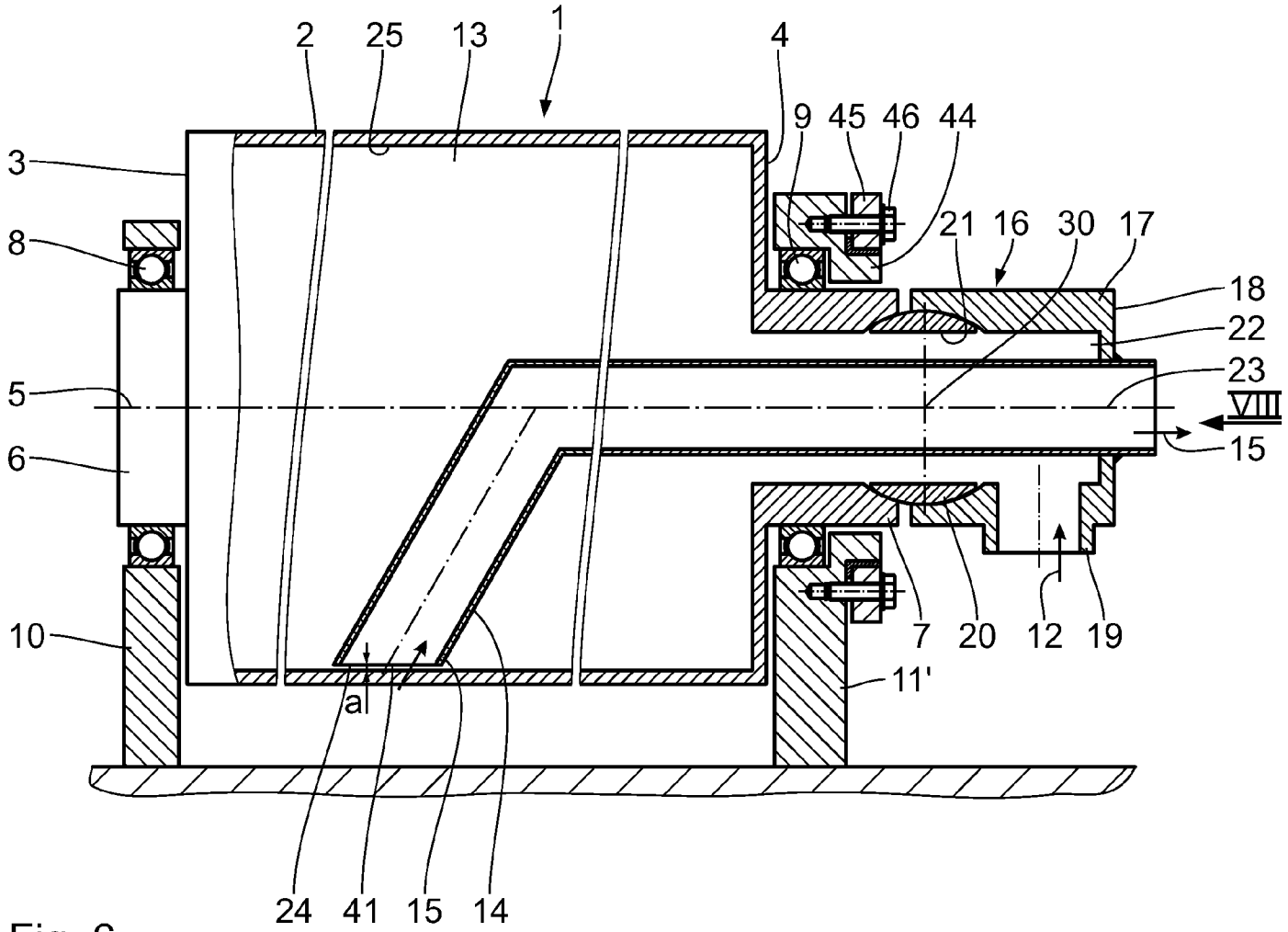
FIG. 6 shows a modified embodiment of the hollow roller in a view according to FIG. 1 with a rotary adjusting device.
Figure 7:
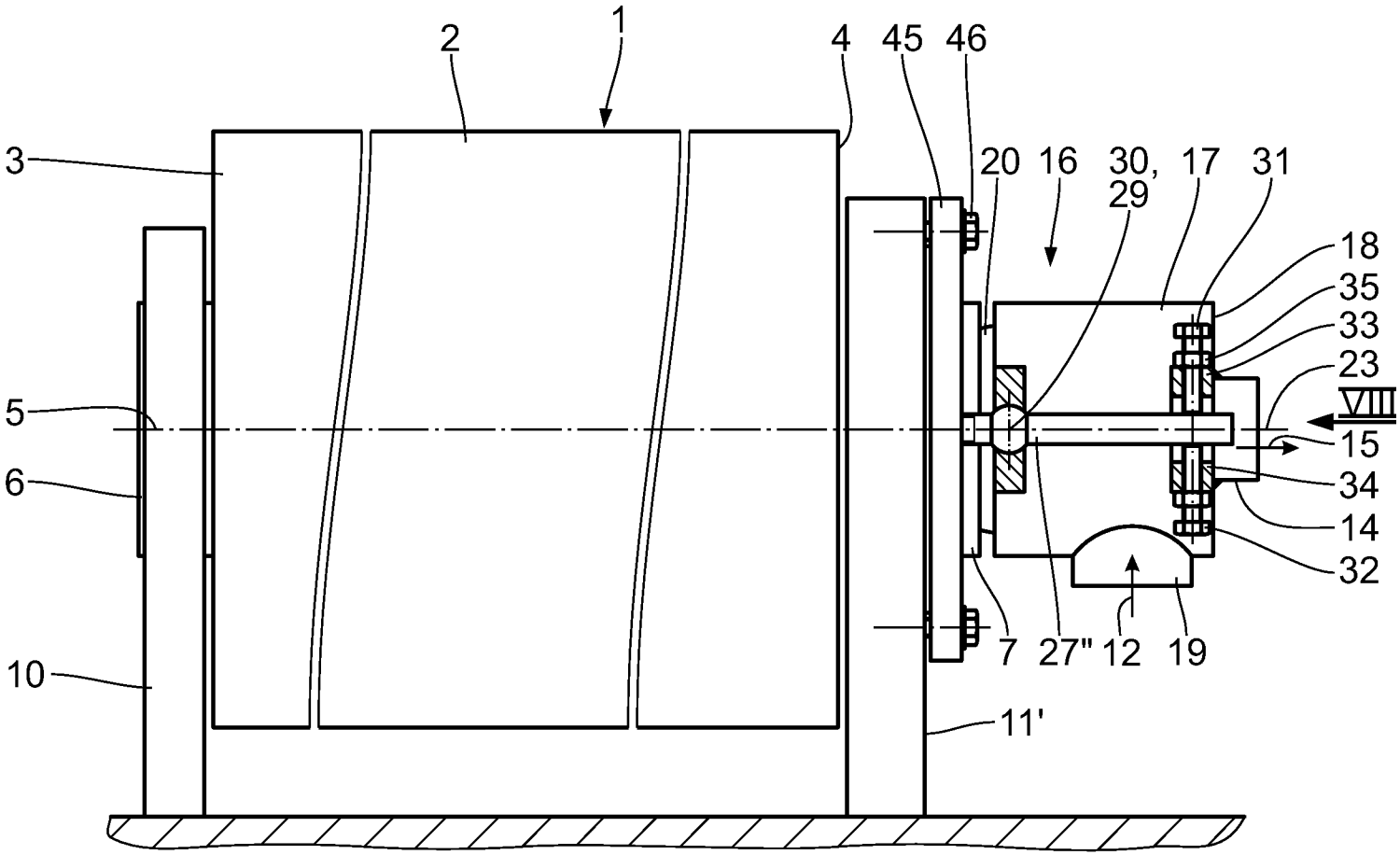
FIG. 7 shows the hollow roller according to FIG. 6 in a view according to FIG. 4.

In the modified embodiment according to FIG. 5, a motor adjustment and fixing of the rotary feed-through 16 is possible. In this pivoting adjusting device, the bearing rods 26', 27' only have the spherical pivot bearings 28. Instead of the adjusting screws 31, 32, a linear drive 36 is provided in the form of a hydraulically or pneumatically drivable piston-cylinder drive, in which one lower end of the cylinder 37 is pivotably articulated to a fixed bearing 38, while the piston rod 39 is articulated in the lower region of the housing 17 by means of a bearing 40. By correspondingly loading the cylinder 37 with pressure fluid, the piston rod 39 is adjusted relative to the cylinder 37, whereby the housing 17 of the rotary feed-through 16 is in turn adjusted in the manner described. The housing 17 is simultaneously fixed in this desired position by hydraulic locking.

Figure 8:
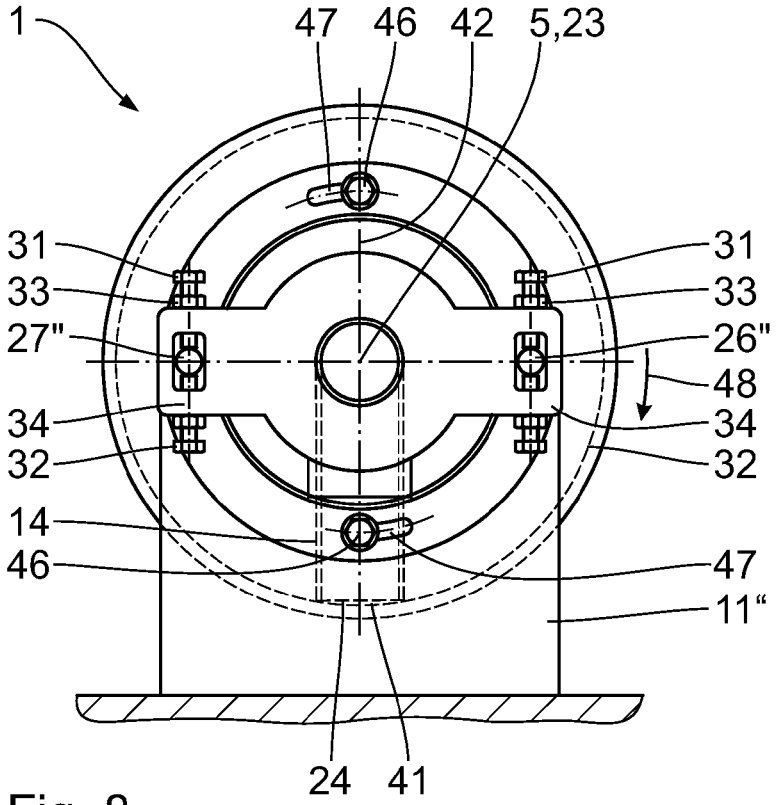
FIG. 8 shows an end view of the hollow roller according to FIGS. 6 and 7 in accordance with the viewing arrow VIII in FIGS. 6 and 7 with a non-rotated siphon pipe.
Figure 9:
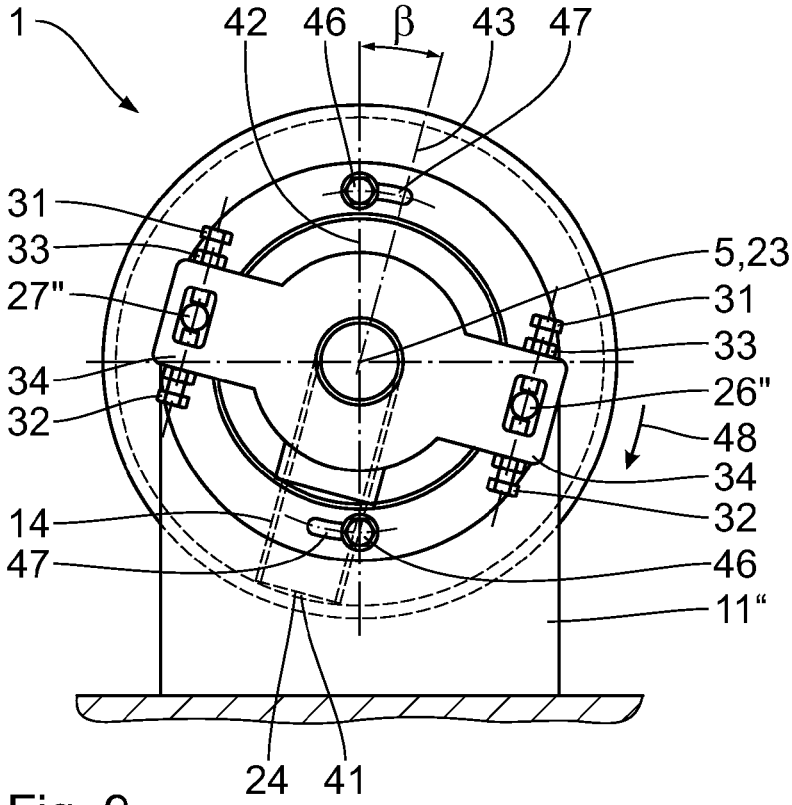
FIG. 9 shows a view in accordance with FIG. 8 with a siphon pipe rotated in the rotational direction of the hollow roller.

The embodiment according to FIGS. 6 to 9 differs from that according to FIGS. 1 to 4 in that not only can the gap 41 between the suction opening 24 of the siphon pipe 14 and the inner wall 25 of the hollow roller 1 be adjusted, but the siphon pipe 14 can also be pivoted by a rotary adjusting device about its main longitudinal axis 23 so the opening 24 is not located in the vertical longitudinal centre plane 42 of the hollow roller 1, as in the embodiment according to FIGS. 1 to 4 or in the position according to FIG. 8, but in a longitudinal centre plane 43 inclined with respect to this about a rotation angle $\beta$, according to FIG. 9. In order to make this possible, configured on the bearing block 11' is a ring bearing 44, on which a ring disc 45 is rotatably mounted. The ring disc 45—as can be seen from FIGS. 6, 8 and 9—is held by means of two screws 46 arranged in the vertical longitudinal centre plane 42 on the bearing block 11'. The screws 46 pass through slots 47 extending in the peripheral direction of the ring disc 45 so that—in accordance with the length of the slots 47—the ring disc 45 can be adjusted about the angle $\beta$ in the peripheral direction, which corresponds to the angle between the planes 42 and 43. The bearing rods 26" and 27" are in this case fastened to the ring disc 45. Otherwise, the structure is as described in FIGS. 1 to 4.

Owing to the adjustment possibility of the ring disc 45, the housing 17 of the rotary feed-through 16 with the siphon pipe 14 can be pivoted about its main longitudinal axis 23, so the opening 24 can be adjusted in the rotational direction 48 of the hollow roller 1. As a result—in particular with hollow rollers 1 driven at high speed—it can be taken into account that the condensate mentioned is entrained in the rotational direction 48. An adjustment of the spacing b of the suction opening 24 from the inner wall 25 of the hollow roller 1, in other words an adjustment of the width of the gap 41, also takes place here by means of the two pairs of adjusting screws 31, 32.

What is claimed is:

1. A hollow roller (1) which is heatable with steam,
which has a roller shell (2) with an inner wall (25), two end walls (3, 4), a centre longitudinal axis (5) and an interior (13),
which is rotatably mounted,
which has a steam supply channel opening into the interior (13) coaxially to the centre longitudinal axis (5) and
which has a siphon pipe (14) which opens into the interior (13) coaxially to the centre longitudinal axis (5), with a suction opening (24) located adjacent to the inner wall (25),
wherein the siphon pipe (14) is formed rigidly and is held in a rotary feed-through (16), which is pivotable relative to the centre longitudinal axis (5) about a pivot angle α in such a way that a spacing b of the section opening(24) from the inner wall (25) is adjustable,
wherein the siphon pipe (14) is rigidly connected to the rotary feed-through (16),
wherein the rotary feed-through (16) is mounted on pivot bearings (28), said pivot bearings (28) are each carried on a bearing rod (26, 27), and
wherein the bearing rods (26, 27) are screwed on either side of a bearing journal (7) of the end wall (4) and a housing (17) of the rotary feed-through (16).

2. A hollow roller (1) according to claim 1, wherein the end wall (4) adjacent to the rotary feed-through (16) is provided with a hollow bearing journal (7), which is rotatably connected to a housing (17) of the rotary feed-through (16) so as to be pivotable about the pivot angle αin a steam-tight manner.

3. A hollow roller (1) according to claim 1, wherein the rotary feed-through (16) has a steam supply connecting piece (19), which passes into the steam supply channel formed as a ring channel (22) surrounding the siphon pipe (14).

4. A hollow roller (1) according to claim 1, wherein a pivoting adjusting device is provided for pivoting adjustment of the rotary feed-through (16) with the siphon pipe (14).

5. A hollow roller (1) according to claim 1, wherein the pivot bearings are arranged in a fixed manner.

6. A hollow roller (1) according to claim 4, wherein the pivoting adjusting device is actuatable manually.

7. A hollow roller (1) according to claim 6, wherein the pivoting adjusting device has adjusting screws (31, 32) for pivoting adjustment.

8. A hollow roller (1) according to claim 4, wherein the pivoting adjusting device is actuatable by a motor.

9. A hollow roller (1) according to claim 1, wherein the rotary feed-through (16) with the siphon pipe (14) is adjustable about the centre longitudinal axis (5) about a rotation angle β.

10. A hollow roller (1) according to claim 9, wherein the rotary feed-through (16) is mounted on a ring disc (45), which is rotatably and fixably supported.

11. A hollow roller (1) according to claim 1, wherein the rotary feed-through (16) is mounted on a ring disc (45), which is rotatably and fixably supported, and wherein the pivot bearings (28) are attached to the ring disc (45).

12. A hollow roller (1) according to claim 1, wherein the rotary feed-through (16) comprises a non-rotatable housing (17), which has an outer base (18), wherein the siphon pipe (14) is rigidly connected to the outer base (18).

13. A hollow roller (1) according to claim 1, wherein a universal ball joint bearing (20) is provided for rotatably connecting the rotary feed-through (16) with a bearing journal (7) of the hollow roller (1).

14. A hollow roller (1) according to claim 13, wherein the ball joint bearing (20) is in direct contact with the housing (17) of the rotary feed-through (16) and with the bearing journal (7).

15. A hollow roller (1) according to claim 13, wherein the ball joint bearing (20) enables pivotable connection of the rotary feed-through (16) with the roller shell (2) relative to the axis (5).

16. A hollow roller (1) according to claim 13, wherein the ball joint bearing (20) is hollow and comprises a cylindrical inner wall (21) and an at least partially spherical outer wall.

17. A hollow roller (1) according to claim 13, wherein the ball joint bearing (20) comprises plastics material.

18. A hollow roller (1) which is heatable with steam,
which has a roller shell (2) with an inner wall (25), two end walls (3, 4), a centre longitudinal axis (5) and an interior (13),
which is rotatably mounted,
which has a steam supply channel opening into the interior (13) coaxially to the centre longitudinal axis (5) and
which has a siphon pipe (14) which opens into the interior (13) coaxially to the centre longitudinal axis (5), with a suction opening (24) located adjacent to the inner wall (25),
wherein the siphon pipe (14) is formed rigidly and is held in a rotary feed-through (16), which is pivotable relative to the centre longitudinal axis (5) about a pivot angle αin such a way that a spacing b of the suction opening (24) from the inner wall (25) is adjustable,
wherein the rotary feed-through (16) is mounted on pivot bearings (28), said pivot bearings (28) are each carried on a bearing rod (26, 27),and
wherein the bearing rods (26, 27) are screwed on either side of a bearing journal (7) of the end wall (4) and a housing (17) of the rotary feed-through (16).

19. A hollow roller (1) according to claim 18, wherein the bearing rods (26, 27) are arranged in a horizontal plane in which the centre longitudinal axes (5) is located.

20. A hollow roller (1) according to claim 18, wherein the bearings rods (26, 27) are arranged parallel to each other.

21. A hollow roller (1) according to claim 18, wherein a pair of adjusting screws (31, 32) are mounted in corresponding laterally projecting abutments (33, 34), wherein the adjusting screws (31, 32) rest against the bearing rod (26, 27).

22. A hollow roller (1) according to claim 21, wherein the adjusting screws (31, 32) are oriented transversally regarding a longitudinal axis of the bearing rod (26, 27).

* * * * *